US006598880B2

(12) United States Patent
Addabbo

(10) Patent No.: US 6,598,880 B2
(45) Date of Patent: Jul. 29, 2003

(54) CARD GAME DECK AND METHODS OF PLAY

(76) Inventor: Daniel F. Addabbo, 2807 E. Drachman St., Tucson, AZ (US) 85716

( * ) Notice: Subject to any disclaimer, the term of this patent is extended or adjusted under 35 U.S.C. 154(b) by 0 days.

(21) Appl. No.: 10/006,317

(22) Filed: Dec. 4, 2001

(65) Prior Publication Data

US 2002/0101037 A1 Aug. 1, 2002

Related U.S. Application Data

(60) Provisional application No. 60/251,378, filed on Dec. 5, 2000.

(51) Int. Cl.[7] ..... A63F 3/00

(52) U.S. Cl. ..... 273/306; 273/303; 273/292; 273/274; 273/309; 273/308

(58) Field of Search ..... 273/303, 309, 273/292, 306, 236

(56) References Cited

U.S. PATENT DOCUMENTS

| | | | | | |
|---|---|---|---|---|---|
| 45,670 | A | * | 12/1864 | Kearney | 209/183 |
| 178,863 | A | * | 6/1876 | Levy | 273/303 |
| 746,868 | A | * | 12/1903 | Moulton | 273/303 |
| 1,803,818 | A | * | 5/1931 | Vail | 273/303 |
| 2,540,211 | A | * | 2/1951 | O'Keefe | 273/292 |
| 5,451,062 | A | * | 9/1995 | Malone | 273/292 |
| 5,467,997 | A | * | 11/1995 | Bashirzadeh | 273/302 |
| 5,697,616 | A | * | 12/1997 | Wilyard | 273/303 |
| 5,863,040 | A | * | 1/1999 | Van Gass | 273/292 |
| 5,887,873 | A | * | 3/1999 | Freeman | 273/303 |
| 5,904,353 | A | * | 5/1999 | Aldridge | 273/292 |
| 6,070,877 | A | * | 6/2000 | Saint-Victor | 273/303 |
| 6,443,456 | B1 | * | 9/2002 | Gajor | 273/303 |
| 6,446,973 | B1 | * | 9/2002 | Pham | 273/306 |

FOREIGN PATENT DOCUMENTS

| | | | | |
|---|---|---|---|---|
| GB | 285610 | * | 2/1928 | A63F/1/00 |
| GB | 2 058 583 | * | 4/1981 | A63F/1/00 |
| GB | 2 286 131 A | * | 9/1995 | A63F/1/02 |

* cited by examiner

*Primary Examiner*—Benjamin H. Layno
*Assistant Examiner*—Dolores R Collins
(74) *Attorney, Agent, or Firm*—Gavin J. Milczarek-Desai; Durando Birdwell & Janke P.L.C.

(57) ABSTRACT

The invention includes specialized card decks and methods of play that revolve around three groups or groups of cards—numerical cards of 3 suits, 3 types face cards, and high cards. In one embodiment of the invention, the card deck consists of 52 specialized cards, which are divided into groups with the following general hierarchy: (1) 4 high cards that trump all other cards and (2) 12 face cards (3 of each type) that trump all 36 numerical suit cards (12 cards of each suit with a numerical value of 1–3). Within each group, the rank of each card is: (1) all high cards are equal; (2) face card X beats face card Y, face card Y beats face card Z, and face card Z beats face card X; (3) higher numbers beat lower numbers of any suit; and (4) suit P beats suit R, suit R beats suit S, and suit S beats suit P. In addition, each card may have a "draw value," i.e. a number of cards that must be drawn by a player as a consequence for playing a particular card.

1 Claim, 25 Drawing Sheets

COOLAVA™

OBJECT: TO BECOME THE FIRST PLAYER TO GO OUT (HOLD NO CARDS).

1. DEAL EACH PLAYER FIVE CARDS (FACE DOWN).
2. PLACE DECK FACE DOWN CENTER OF PLAY AREA.
3. FLIP OVER TOP CARD OF DECK AND PLACE IT NEAR THE DECK (THIS IS THE DISCARD PILE).
4. EACH PLAYER THEN TAKES TURNS IN A CLOCKWISE ROTATION, PLACING ONE CARD ON TOP OF THE DISCARD PILE (DRAWING CARDS AS NECESSARY) ATTEMPTING NOT TO DRAW ANY.

EXAMPLE: IF CARD ON TOP OF THE DISCARD PILE IS A CARD WITH 2 ROCKS:

A) A CARD PLACED ON TOP WITH 2 PAPERS WOULD NOT DRAW BECAUSE 2 PAPERS COVER 2 ROCKS.
B) A CARD PLACED ON TOP WITH 1 PAPER WOULD DRAW 1 CARD BECAUSE 1 PAPER COVERS ONLY 1 ROCK, LEAVING 1 ROCK LEFTOVER.
C) A CARD PLACED ON TOP WITH 2 SCISSORS WOULD DRAW 2 CARDS BECAUSE 2 ROCKS BREAK BOTH OF THE SCISSORS.
D) A CARD PLACED ON TOP WITH 1 SCISSORS WOULD DRAW 2 CARDS BECAUSE 2 ROCKS BREAK THE SCISSORS.

FIG. 2A

2

E) A CARD PLACED ON TOP WITH 2 ROCKS WOULD DRAW 2 CARDS BECAUSE ANYTIME YOU PLACE A SAME CARD ON TOP OF ITSELF, YOU DRAW THE VALUE OF THAT CARD...ie... 2 ROCKS ON TOP OF 2 ROCKS = 2 CARDS.

F) A CARD PLACED ON TOP WITH 1 ROCK WOULD DRAW 1 CARD BECAUSE 2 ROCKS - 1 ROCK = 1.

G) ANY CARD PLACED ON TOP WITH 3 (P)PAPERS, 3 (R)ROCKS OR 3 (S)SCISSORS WOULD NOT DRAW BECAUSE ANY 3 PRS CARDS ARE BETTER THAN ANY 2 PRS CARDS.

H) LAVA, ROBOTS, TIME MACHINES AND UFOs PLACED ON TOP WOULD NOT DRAW BECAUSE THEY'RE BETTER THAN ANY PRS CARD.

NOTE: SEE BASIC RULES HOW OTHER CARDS DRAW ( LAVA, ROBOTS, TM AND UFOs)

VIP: ANOTHER PLAYER NEVER DRAWS FOR WHAT YOU PUT ON TOP OF THE DISCARD PILE. YOU ONLY DRAW (IF NEEDED) FOR WHAT YOU PUT ON TOP OF THE DISCARD PILE.

OR (PLAY ONE ON ONE)

A) PLAY THIS WAY BY DRAWING CARDS AGAINST THE BEST CARD PLAYED.

B) ALL PLAYERS SET DOWN 1 CARD, SAME TIME.

C) USE SAME RULES AS ABOVE. BEST CARD DOES NOT DRAW. OTHER PLAYERS DRAW NEEDED CARDS FROM DRAW CARD PILE AGAINST THE BEST CARD, DISCARDING PLAYED INTO A PILE.

FIG. 2B

COOLAVA BLACKJACK

1) DEALER GETS 1 CARD UP / 1 CARD DOWN. PLAYER GETS 2 CARDS DOWN.
2) PLAYER THEN PICKS UP OWN CARDS AND CHOOSES 1 OF THEM TO MATCH OR BEAT THE DEALERS UP CARD.
3) PLAYER THEN PLACES THAT CARD DOWN (FACE UP) & ITS OTHER CARD SIDEWAYS ON TOP OF IT (ALSO FACE UP). THE SIDEWAYS CARD THEN PLAYS AGAINST DEALERS DOWN CARD.
4) DEALER THEN FLIPS OVER ITS DOWN CARD.
5) THE BETTER OF THESE 2 CARDS WINS (THE PLAYERS SIDEWAYS AND THE DEALERS DOWN). IF THEY MATCH, THE PLAYER PUSHES (WINS).

NOTE: IF NEITHER OF THE PLAYERS 2 CARDS BEAT THE DEALERS UP CARD, PLAYER LOSES (DEALER WINS).

IF A PLAYER HAS 2 IDENTICAL CARDS, PLAYER MAY SPLIT THEM & GET 1 MORE ON EACH. NEW CARDS WILL PLAY AGAINST THE DEALERS DOWN.

COOLAVA POKER RUMMY & SOLITARE

1) PLAY LIKE YOU WOULD, USING COOLAVA RULES.
   SAMPLE PAIR: 1 RED ROCK & 1 BLACK ROCK.
   NOT A PAIR: 1 RED ROCK & 1 RED PAPER.
2) STRAIGHTS & SOLITARE ORDER: LAVA, 1 PAPER, 2 PAPERS, 3 PAPERS, 1 ROCK, 2 ROCKS, 3 ROCKS, 1 SCISSORS, 2 SCISSORS, 3 SCISSORS, ROBOTS, TIME MACHINES, UFOs & LAVA.

ENJOY HAVE FUN KEEP PLAYING

COOLAVA PLAYCO INC.

FIG. 2C

BASIC COOLAVA RULES

PAPER (IS BETTER THAN) ROCK
ROCK (IS BETTERR THAN) SCISSORS
SCISSORS (IS BETTER THAN) PAPER
(ANY 3 PRS IS BETTER THAN ANY 2 PRS)
(ANY 2 PRS IS BETTER THAN ANY 1 PRS)
(EXACT SAME ON SAME DRAWS # ON CARD)

---

ROBOTS (ARE BETTER THAN) TIME MACHINES
TIME MACHINES (ARE BETTER THAN) UFOs
UFOs (ARE BETTER THAN) ROBOTS
(THESE ARE BETTER THAN ANY PRS CARD)
(THESE FORCE PRS CARDS TO DRAW # ON CARD)
(THESE DRAW 3 IF ANOTHER IS BETTER/EXACT SAME)

---

LAVA IS THE BEST
(LAVA LETS THE PRS CARDS GO FREE)
(FORCES THE ROBOTS, TM & UFOs TO DRAW 3)
(LAVA ON LAVA DRAWS 4)

---

PAT PENDING,TM & COPYRIGHT 2000 2001 DAN ADDABBO. ALL RIGHTS RESERVED.
USED UNDER LICENCE BY TM & COPYRIGHT 2000 2001 PLAYCO INC.. ALL RIGHTS RESERVED.

FIG. 2D

CARD GAME DECK AND METHODS OF PLAY

STATEMENT OF RELATED APPLICATION

This application is based on U.S. Provisional Patent Application Ser. No. 60/251,378 entitled "Deck of Playing Cards for Playing Card Games," filed on Dec. 5, 2000.

BACKGROUND OF THE INVENTION

1. Field of the Invention

This invention relates generally to the field of card games. In particular, it relates to specialized playing card decks and methods of play therewith.

2. Description of the Related Art

Playing cards have been around and in use for many centuries by people on every continent. The first reliable evidence that cards were played is during the year 1376 in Florence, Italy, by way of a game called "Naibbe." The primary purpose of playing cards, then as now, has been to provide for social interactions involving a plurality of players.

Of course, a wide variety of cards games have been developed over time and can be loosely categorized into three major groups: "casino style" games that involve wagering (poker, blackjack, etc.), trick-taking games (pinochle, hearts, spades, et al.), and discard games (e.g. Uno™) in which the object is to "go out," i.e., by the first player to hold no cards. While the rules for each of these games varies, most if not all revolve around a predetermined hierarchy of winning hands or allowable plays based on the rank of, or instructions on, a particular card.

Traditionally, a standard deck of playing cards is composed of three groups of cards that feature (1) numerical indicia (e.g. deuce through ten), (2) a "face" or non-numerical character of a certain rank (e.g. jack, queen, king), and (3) a "high card" designation (e.g. Ace). These three groups of cards represent a standard hierarchy or sequential order of ranking, e.g., from deuce being the lowest to ace being the highest. Additionally, each numerical, face card, and high card is marked with one of four suits (traditionally, hearts, spades, diamonds, and clubs).

The ever-increasing choice of card games and variations thereof is testament to the presence of player demand for new games, including those that require a unique deck of cards. The applicant is not aware of any card games that are played with a deck of cards containing groups of cards that feature either: (1) high cards of no suit, (2) face cards of no suit, and (3) cards with numerical indicia in one of only three suits; or (1) high cards of one of four suits (e.g. different colors), (2) face cards of one of four suits (e.g. different colors), and (3) cards with numerical indicia in two of seven suits (e.g. four different colors and 3 different graphics or symbols). Therefore, while traditional card games are fun, the applicant has developed new deck of cards and methods of play therewith to satisfy the continuing need in the art for new and interesting games that challenge and entertain players.

BRIEF SUMMARY OF THE INVENTION

The invention relates in general to specialized card decks and methods of play that revolve around three groups of cards. In one embodiment of the invention, the card deck generally contains numerical cards of three suits, three types face cards of no suit, and high cards of no suit. More specifically, the card deck of this embodiment features cards that are divided into groups with the following general hierarchy (specific examples of each card type are illustrated in FIG. 1): (Group 1) one type of high card that trumps all other cards in the deck (e.g. winking smiling face), (Group 2) three types of face cards (e.g. robots, time machines, and UFO's or x, y, and z generically) that trump all cards of Group 3, and (Group 3) three types of cards having suits (e.g. three different markings, such as paper, rock, and scissors or p, r, and s for short) and a numerical-value, wherein the numerical value ranges from one to three.

Within each group, the rank of each card is: (1) all high cards are equal; (2) face card x beats face card y, face card y beats face card z, and face card z beats face card x; (3) higher numbers beat lower numbers of any suit, and suit p beats suit r, suit r beats suit s, and suit s beats suit p. In addition, each card may have a "draw value," i.e. a number of cards that must be drawn by a player as a consequence for playing a particular card as will be more fully illustrated in the rules described below.

In a preferred method of play for the first embodiment of the deck of cards, the object of the game is to become the first player to "go out" by playing a card on the discard pile. The basic rules and sequence of events include: (1) Deal each player five cards face down; (2) Place deck face down in center of play area; (3) Flip over top card of deck and place it near the deck (this is the discard pile); (4) Each player then takes turns in a clockwise rotation, placing one card on top of the discard pile (drawing cards as necessary, but attempting to draw none).

Players draw cards according to the following general rules based on the card they play on the top card of the discard pile: (A) beating (i.e. outranking or trumping) the top card results in drawing no cards; (B) identically matching the top card results ; in drawing either (1) the number on the card (for p, r, and s suit cards), (2) 3 cards (for x, y, and z face cards), or (3) 4 cards (for high cards); (C) not beating the top card results in drawing either (1) if p, r, or s cards are involved, refer to Table 1, (2) x, where x is the numerical value of the card played if played on any face card, or (3) zero for any numerical suit card that is played on a high card or 3 cards for any face card played on a higher ranking face card or on a high card. These rules, the rank of cards, and the hierarchy among card groups or groups is summarized in FIG. 2 and Table 1.

In another embodiment of the invention, the deck of cards generally contains numerical cards, each card having two of seven suits, 3 types face cards having one of four suits, and high cards having one of four suits. More specifically, the card deck of this embodiment features cards that are divided into groups with the following general hierarchy (from highest to lowest): (Group 1) high cards, each card having one of four suits (e.g. four different colors) that trump all other cards in the deck, (Group 2) three types of face cards (x, y, and z), each card having one of four suits (e.g. four different colors), that trump all cards of Group 3, and (Group 3) three types of cards having two of seven suits (p, r, or s), and one of four additional suits, e.g. four different colors) and a numerical value, wherein the numerical value ranges from one to three. For the purposes of a "straight" (sequence of cards in a hand), the basic linear rank of each card is, from lowest to highest: high card (functioning as an "ace low"), 1p, 2p, 3p, 1r, 2r, 3r, 1s, 2s, 3s, face card x, face card y, face card z, and high card (functioning as an "ace high").

A preferred method of play with the deck of cards of the second embodiment of the invention generally involves a variation on "poker rules," with sequences, suits (e.g. p, r, s of one of four colors), face cards (e.g. x, y, z of one of four colors), and high cards (of one of four colors) being used to create hands such as flushes, straights, pairs, etc. These hands are defined and ranked, from highest to lowest, as follows:

(1) High Card Straight Flush (High card straight, all same color);
(2) Four-of-a-Kind High (Four identical cards with a high card);
(3) Straight Flush (straight, all same color);
(4) Four-of-a-Kind (Four identical cards and another card);
(5) Full House (Three identical cards with a pair);
(6) High Flush (All same color);
(7) Straight (Sequence of cards according to linear rank);
(8) Three-of-a-Kind (Three identical cards, no pair);
(9) Low Flush (Five cards with all p, r, or s on each OR any five p, r, or s cards with the same number on each);
(10) Two Pairs (Two sets of two identical cards and another card);
(11) Minor Flush (Four cards with all p, r, or s on each and another card OR any four p, r, or s cards with the same number on each and another card);
(12) One Pair (Two identical cards and three other cards);
(13) High Card ("Ace" card and four other cards); and
(14) Sum of Cards (Numerical value of all cards, counting numbers as face value, and face cards as four each).

The decks and games played therewith have been designed and play tested to bring hours of wholesome entertainment, to provide a counting and strategy imparting educational tool for young children, and to be used for social interactions wherever a plurality of players may congregate. The different types of games in which these cards are to be used are described in more detail within the detailed description of the invention.

A principal objective of this invention is to provide a new and improved card game based on specialized decks of playing cards.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose but some of the various ways in which the invention may be practiced. All publications cited are hereby incorporated by reference in their entirety herein.

BRIEF DESCRIPTION OF THE DRAWINGS

FIG. 2 illustrates a summary of the rules, the rank of cards, and the hierarchy among card groups of the preferred methods of game play.

DETAILED DESCRIPTION OF THE INVENTION

Figure 1:
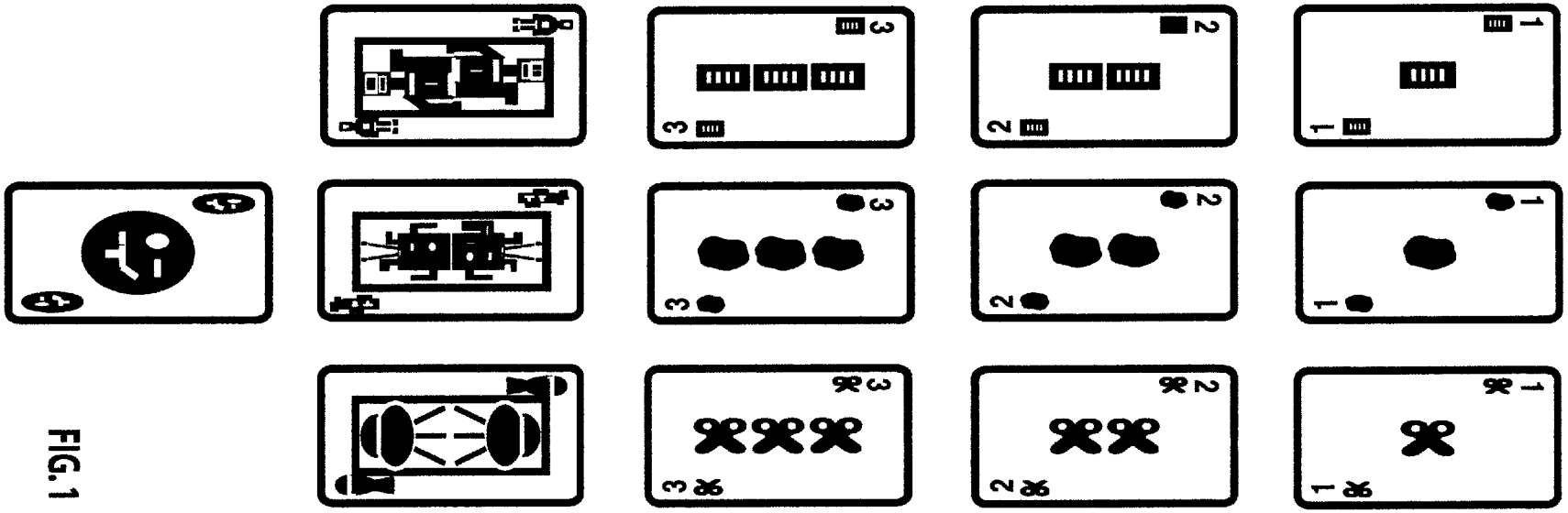
FIG. 1 illustrates the 13 different types of cards that are useful for either card deck embodiment of the invention. Each card is replicated four times in a different color to form a standard 52 card deck.
Figure 3:
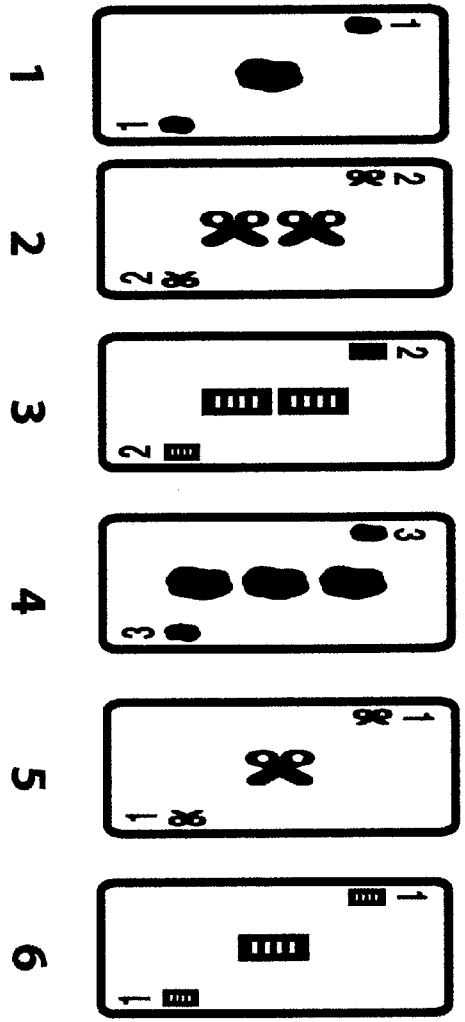
FIGS. 3–38 schematically depict sample cards and hands according to the invention.
Figure 4:
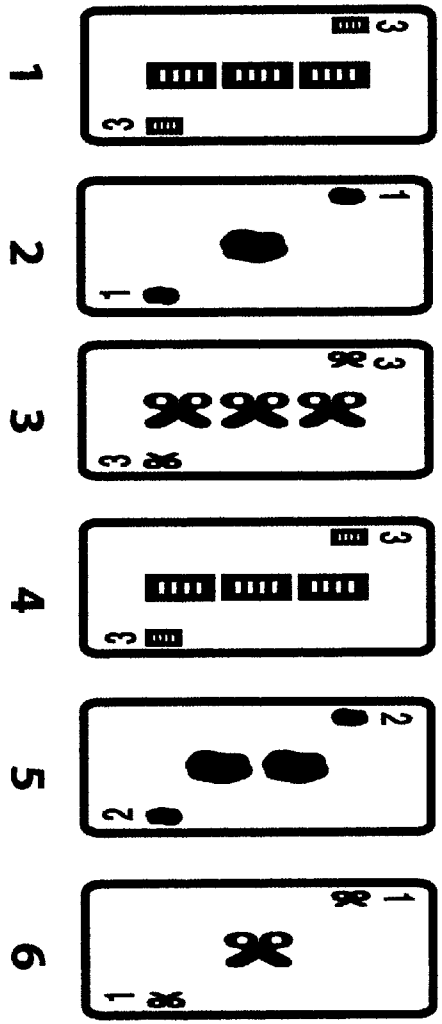
Figure 5:
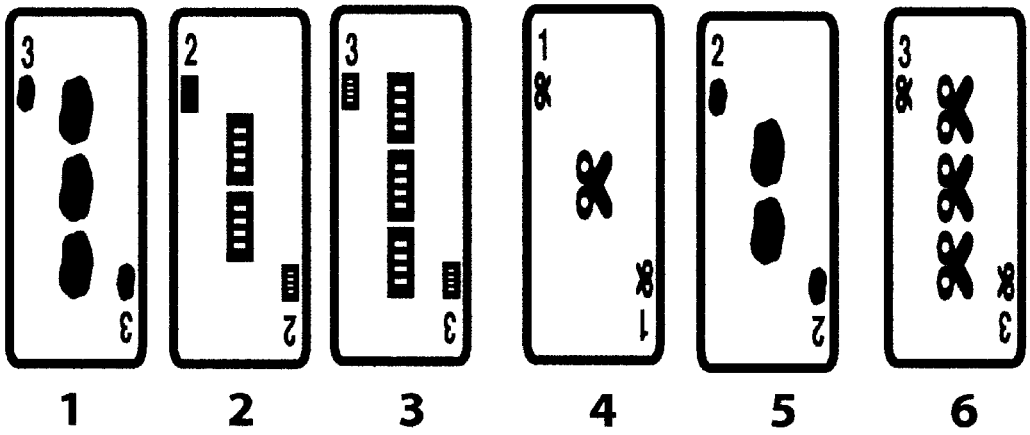
Figure 6:
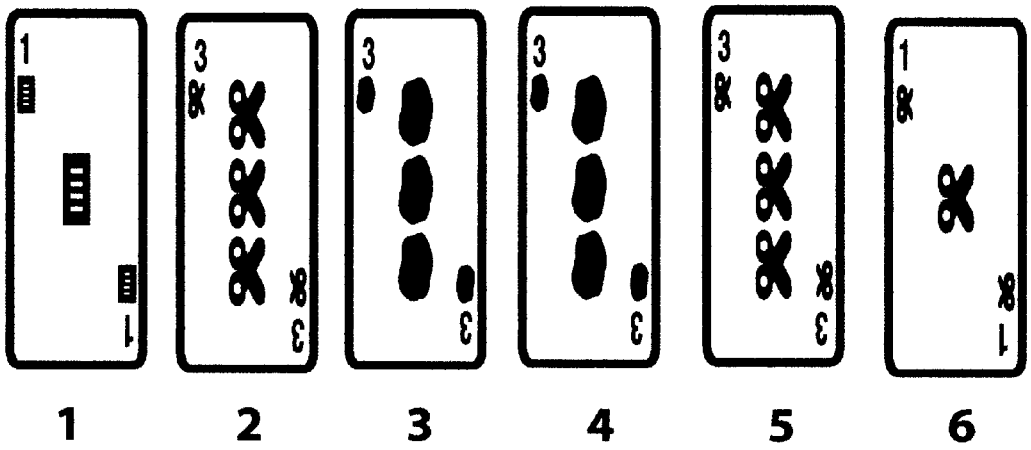
Figure 7:
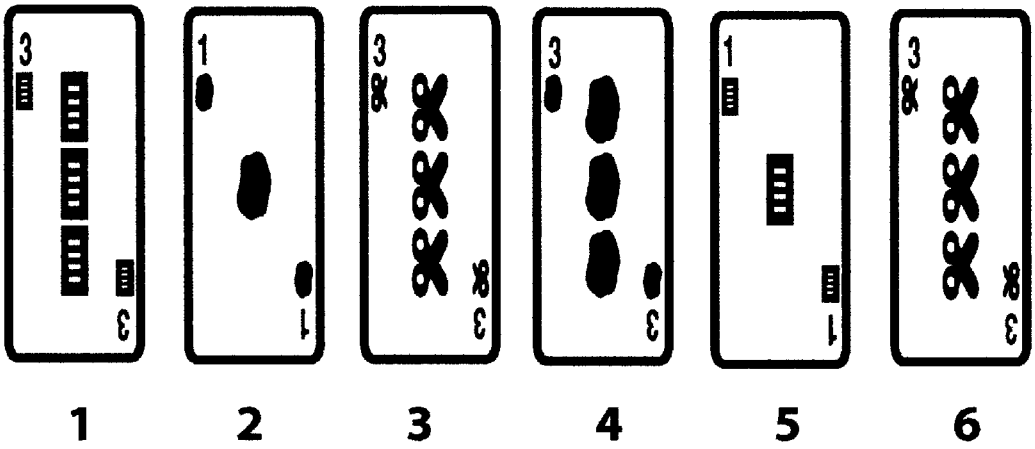
Figure 8:
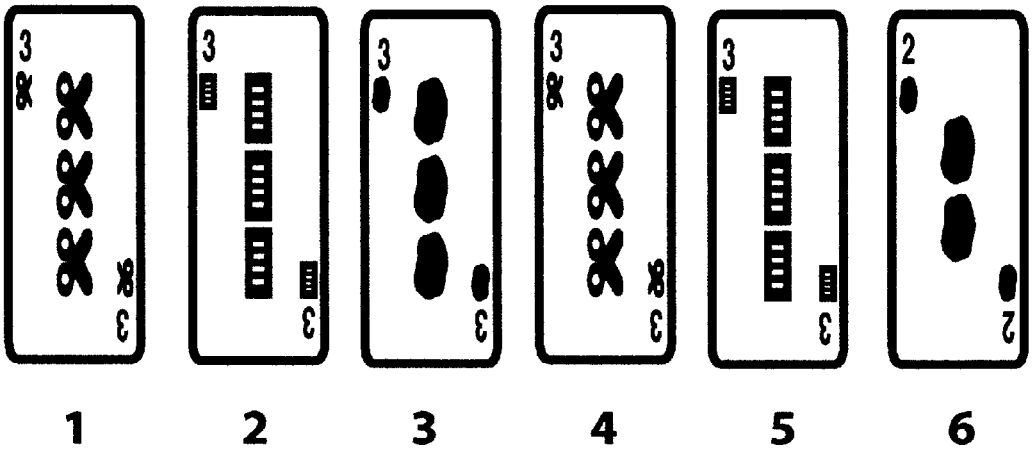
Figure 9:
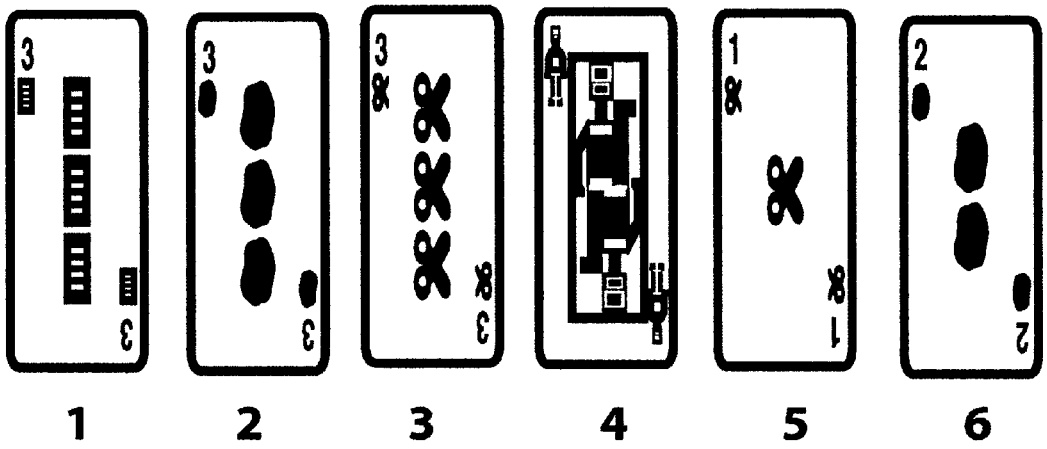
Figure 10:
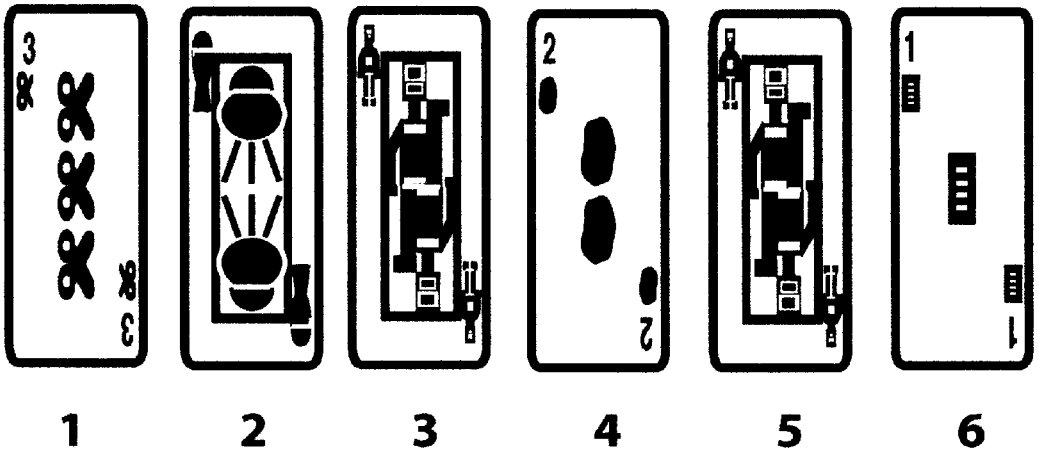
Figure 11:
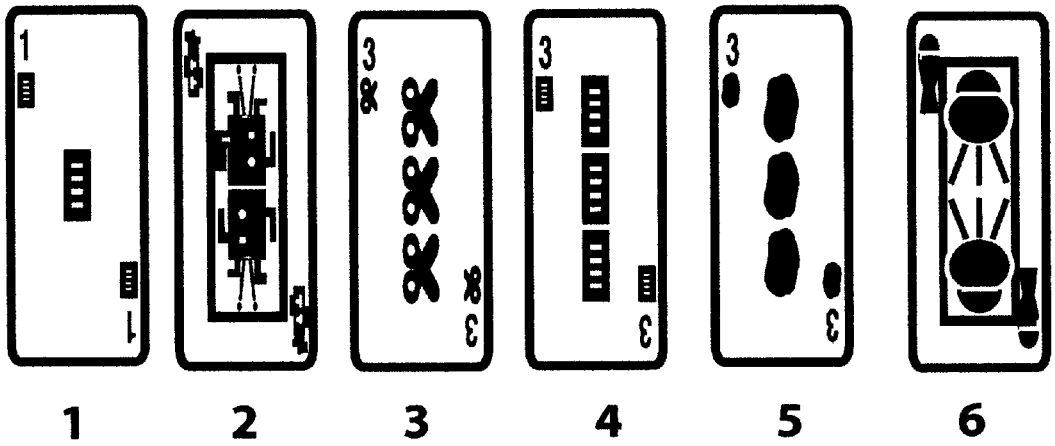
Figure 12:
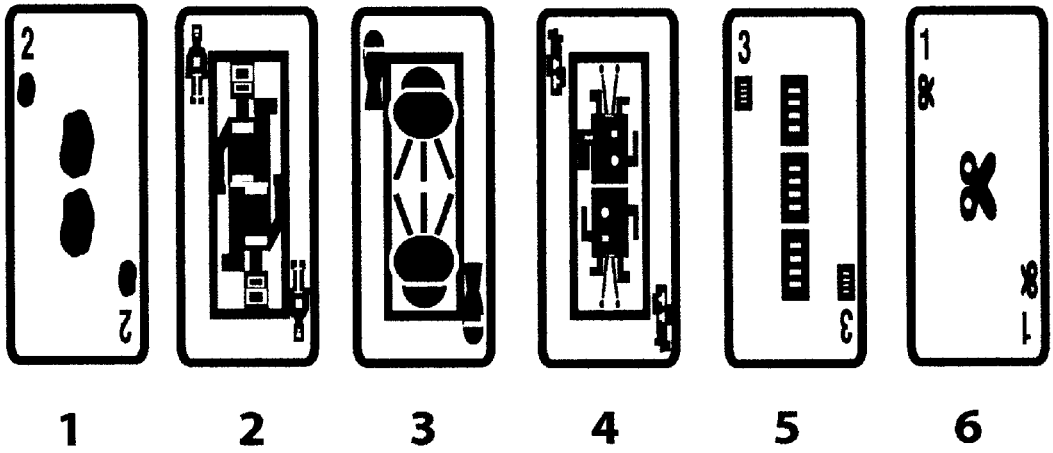
Figure 13:
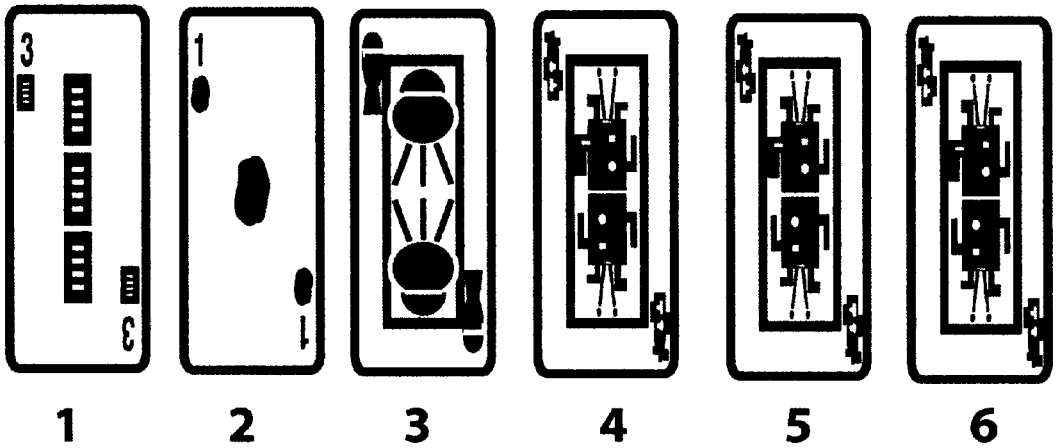
Figure 14:
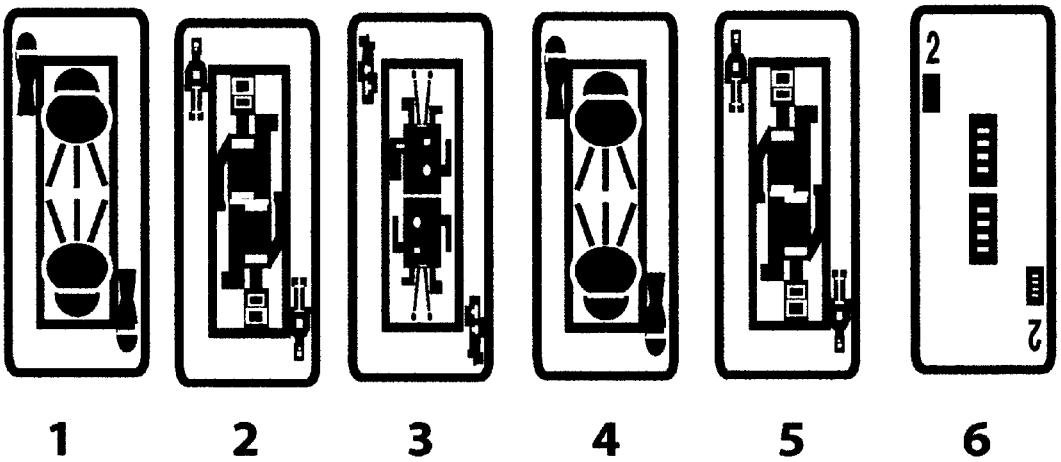
Figure 15:
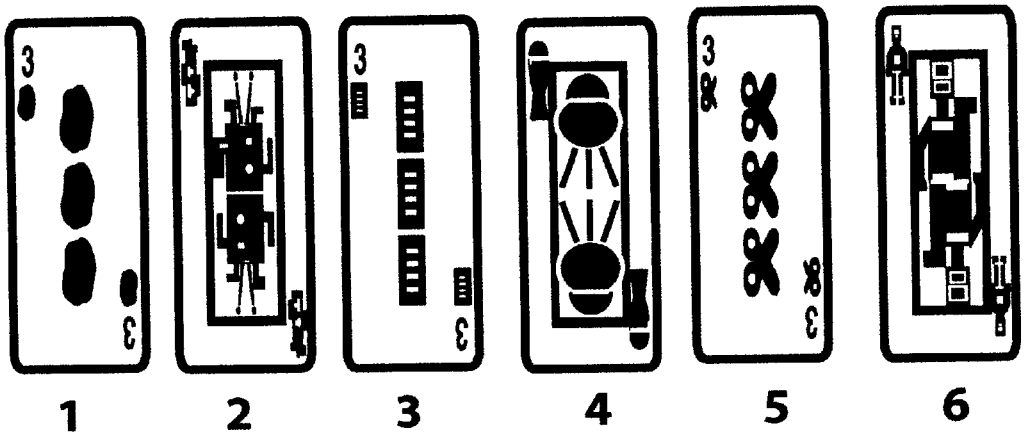
Figure 16:
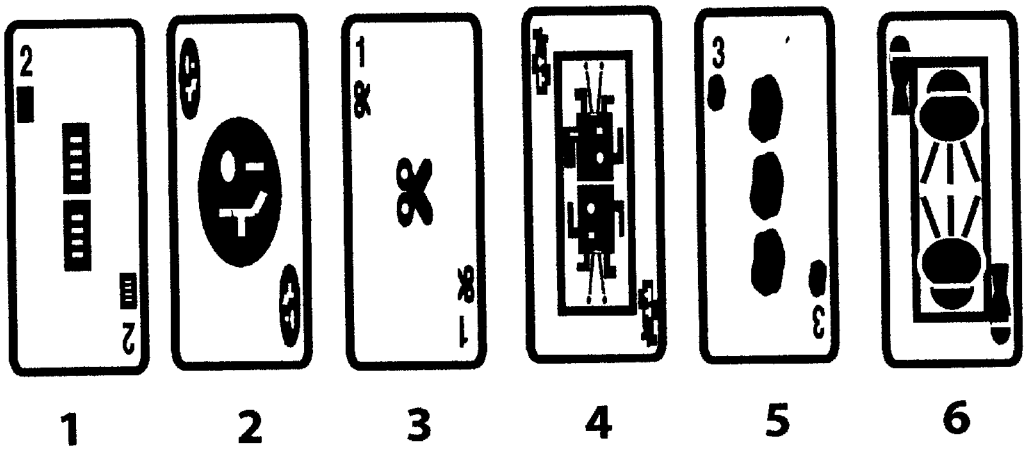
Figure 17:
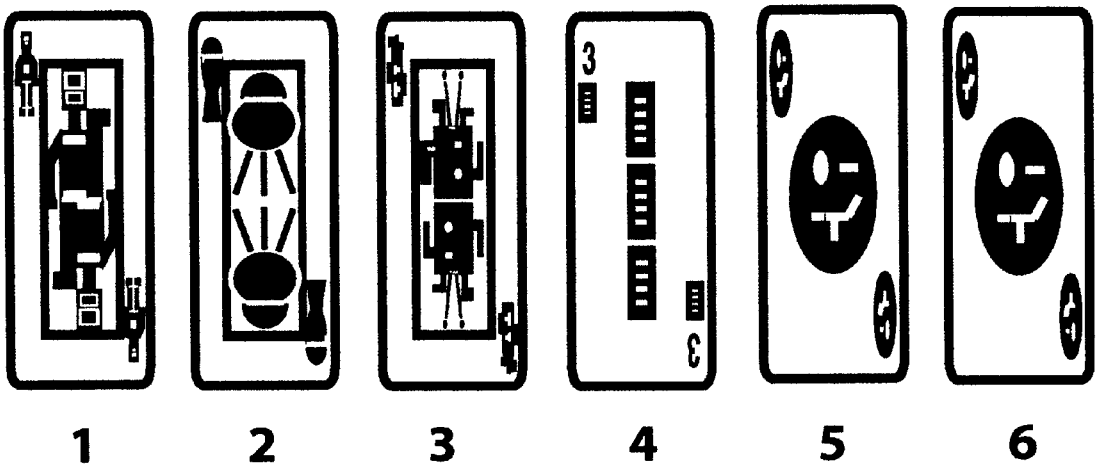

The invention includes unique card decks and methods of play that relate to three groups or groups of cards. In one embodiment of the invention, the deck of cards generally contains (1) numerical cards of three suits, (2) three types of face cards of no suit, and (3) high (or "Ace") cards. In another embodiment of the invention, the deck of cards generally contains numerical cards, each card having two of seven suits, three types face cards having one of four suits, and high cards having one of four suits. While the actual size of the cards may vary, the preferred deck is the size of standard playing cards, approximately three and a half inches by two and a half inches.

There are several different types of games that one to six players can play with these specialized playing cards. To best illustrate the general hierarchy and methods of play of the different embodiments of the invention, the following non-limiting examples are provided. For the sake of illustration and consistency throughout the description that follows, the general suits and types of face cards are defined as specific graphics or symbols. Thus, p=paper, r=rocks, s=scissors, x=robots, y=time machines, and z=ufo's. Nonetheless, as would be realized by one skilled in the art, other graphics, symbols, or depictions may be substituted for those described below so long as they are consistent with the rules of play.

The First Game ("Basic Rules")

There are three different groups of cards in this deck. Below are listed the groups of cards and their hierarchical relationship with the other cards in their own groups, as well as their interactions with the other groups of cards in the deck.

GROUP A) Paper, Rock and Scissor Cards with Numerical Values

Paper covers (is better than) Rock, Rock breaks (is better than) Scissors, Scissors cut (is better than) Paper. The numerical value of the Paper, Rock and/or Scissor card will determine which is the better card within this group. Example: A card appearing with three Rocks is better than a card appearing with two Papers because two Papers cover two Rocks, leaving one Rock leftover. A card appearing with two Papers is better than a card appearing with two Rocks because the two Papers cover both the Rocks.

GROUP B) Face Cards: Robots, Time Machines and UFO's

The robots smash (are better than) the Time Machines, The Time Machines control (are better than) the UFO's, The UFO's swallow (are better than) the Robots. The Robots, Time Machines and UFO's are better than any of the Paper, Rock and/or Scissor cards.

GROUP C) High Cards (e.g. Lava Cards)

Lava cards are better than any card in the deck.

The object of the first game is for all the players to play one card at a time, at the same time against each other, with an attempt to not draw cards or as few as possible. To win, one must become the first player to hold no cards with the last card played being discarded.

To begin the first game, one person is selected to shuffle the cards well and to distribute amongst all the players five cards each, all face down. The remainder of the cards are to be placed in the center of the playing card area, in one pile, all face down. These will be the draw card pile.

To play the game, each player picks up his or her cards and chooses one card from his or her own hand that he or she wishes to play. Each player then places that card face down in front. Once each player has placed a card down, clockwise, each player is to take turns flipping over his or her own card, beginning with the person who held the lead card the previous hand. During the very first hand of play, the first person to flip over his or her own card is the person who dealt the cards. In the case of equal lead cards from the previous hand, the first person to flip over his or her card is the person who flipped over the first lead card the previous hand. When all the cards have been flipped over, it's time to determine the lead card.

The lead card or cards (e.g. equal leads) is what all the other cards play against. Equal lead cards are two or more identical cards that act as a lead card. The lead card is determined by its greater numerical value appearing on its face and/or its strength over the other cards played (see basic rules, FIG. 2). Thus, the lead card is the best card played, and is not eliminated.

Eliminated cards become eliminated when three or more cards, in the same groups of cards as described in the basic rules, equally attack each other, only when they are to become the lead cards. Should three or more cards equally attack each other within a group of cards, and another card appear in a group which is better, those cards are not eliminated. Lava cards never eliminate each other. Eliminated cards never draw cards.

Players draw cards by playing against the lead card. The lead card or cards (equal leads) never draw cards unless it is a Lava card and two or more appear. Lava lets the Paper, Rock and Scissor cards go free, forcing the Robots, Time Machines and UFO's to draw three. Should Lava appear, two or three, places or more, Lava will draw four. When the Robots, Time Machines or UFO's become the lead card, players holding Paper, Rock and/or Scissor cards draw the amount of cards determined by the number appearing on their cards. Players holding Robots, Time Machines and/or UFO cards always draw three cards when one of those or Lava becomes the lead card. Should all cards eliminate each other with one card remaining, the player holding that card is to draw the number of cards determined by the number appearing on its face. When the lead card is a Paper, Rock or Scissor card, players are to draw their needed amount of cards by applying the basic rules. Example: Should the lead card be a card with three Scissors appearing on its face . . . a card with two Scissors would draw one card because two Scissors have eliminated each other, a card with two Rocks would draw one card because two Rocks break two Scissors, a card with two Papers would draw three cards because the Paper is cut by three Scissors.

Players are to draw their needed cards from the draw card pile beginning clockwise from the lead card. In the case of equal leads, players are to draw from the draw card pile beginning clockwise from the lead card that was turned over first. Once each player has drawn their appropriate number of cards from the draw card pile, the card they played is to be placed in a discard pile. The discard pile is to be separate from the draw card pile. The lead card or cards are to be placed in the discard pile immediately after all the players have drawn their needed cards. Once the lead card or cards have been placed in the discard pile, it is time to choose another card to lay down and play as you did the previous hand. The discard pile is to be reshuffled and used only as needed to replenish the draw card pile.

Should at any time of play, the draw card pile combined with the discard pile cards run out, the way of drawing cards begins to change. Players are then to draw their respective number of cards from the lead cards hand. In the case of equal leads, players are to draw their cards, the same way as above, one card at a time, alternating clockwise from the lead cards hands, beginning with the lead card that was turned over first. Discarded cards will then be out of play for the remainder of the game. Equal Lava leads never draw cards during this method of draw. Either way of drawing cards, the first player to hold no cards after discarding their final card is the winner. Should equal leads tie, the first lead who held no cards wins.

To play a quick version of this game, the same rules are used, however, the game starts differently. The game is started by distributing all the cards equally amongst all the players, discarding any left over. Play continues as normal without the draw card pile, drawing cards as needed from the lead or lead cards hands, with a player winning the same way as above.

The following chart may be used to determine how many cards are to be drawn, only when the lead card or cards are Paper, Rock or Scissor cards.

TABLE 1

Draw Card Chart
Find the lead card in the left column going up and down. Find the card playing against it in the top column. Connect the columns and that's how many cards to draw.

| IF LEAD CARD IS↓ | THEN→ | 3 | 2 | 1 | 3 | 2 | 1 | 3 | 2 | 1 |
|---|---|---|---|---|---|---|---|---|---|---|
| | | PAPERS DRAW | | | | ROCKS DRAW | | SCISSORS DRAW | | |
| 3 PAPERS | | 0 | 1 | 2 | 3 | 3 | 3 | ** | 1 | 2 |
| 2 PAPERS | | ** | 0 | 1 | ** | 2 | 2 | ** | ** | 1 |
| 1 PAPER | | ** | ** | 0 | ** | ** | 1 | ** | ** | ** |
| 3 ROCKS | | ** | 1 | 2 | 0 | 1 | 2 | 3 | 3 | 3 |
| 2 ROCKS | | ** | ** | 1 | ** | 0 | 1 | ** | 2 | 2 |
| 1 ROCK | | ** | ** | ** | ** | ** | 0 | ** | ** | 1 |
| 3 SCISSORS | | 3 | 3 | 3 | ** | 1 | 2 | 0 | 1 | 2 |
| 2 SCISSORS | | ** | 2 | 2 | ** | ** | 1 | ** | 0 | 1 |
| 1 SCISSORS | | ** | ** | 1 | ** | ** | ** | ** | ** | 0 |

0 Draw no cards. Ties with lead card. Equal leads.
**These cards will not appear as the lead card is the best card played.

When the Robot, Time Machine or UFO is the lead card or cards, the Paper, Rock and/or Scissor cards are to draw the same number of cards as the number appearing on each of their cards.

When a Robot, Time Machine and/or UFO becomes the lead card over one of their own (i.e., a Robot, Time Machine or UFO), players draw three cards each.

When Lava is the lead card, the players with Paper, Rock and/or Scissor cards do not draw. Players with the Robot, Time Machine and UFO cards are still required to draw three cards each.

Sample Hands

The following sample hands (FIG. 3–FIG. 17) represent six players, all playing one card each, with reference of how many cards to draw after determining the Lead card.

FIG. 3

1. Draw 2 cards because 1 Rock eliminates 1 Rock.
2. Draw 3 cards because 3 Rocks break Scissors.
3. Draw 1 card because 2 Papers cover 2 Rocks.
4. LEAD CARD.
5. Draw 3 cards because 3 Rocks break Scissors.
6. Draw 2 cards because 1 Paper covers 1 Rock.

FIG. 4

1. Draw 3 cards because 3 Scissors cut Papers.
2. Draw 2 cards because 1 Rock breaks 1 Scissors.

3. LEAD CARD.
4. Draw 3 cards because 3 Scissors cut Papers.
5. Draw 1 card because 2 Rocks break 2 Scissors.
6. Draw 2 cards because 1 Scissors eliminates 1 Scissors.

FIG. 5

1. 1, 3 and 6 eliminate each other. Draw no cards.
2. LEAD CARD.
3. 1, 3 and 6 eliminate each other. Draw no cards.
4. Draw 1 card because 1 Scissors cut 1 Paper.
5. Draw 2 cards because 2 Papers cover Rocks.
6. 1, 3 and 6 eliminate each other. Draw no cards.

FIG. 6

1. Draw 2 cards because 1 Paper covers 1 Rock.
2. Draw 3 cards because 3 Rocks break Scissors.
3. EQUAL LEADS.
4. EQUAL LEADS.
5. Draw 3 cards because 3 Rocks break Scissors.
6. Draw 3 cards because 3 Rocks break Scissors.

FIG. 7

1. 1, 3, 4 and 6 eliminate each other. Draw no cards.
2. Draw 1 card because 1 Paper covers 1 Rock.
3. 1, 3, 4 and 6 eliminate each other. Draw no cards.
4. 1, 3, 4 and 6 eliminate each other. Draw no cards.
5. LEAD CARD
6. 1, 3, 4 and 6 eliminate each other. Draw no cards.

FIG. 8

1. 1, 2, 3, 4 and 5 eliminate each other. Draw no cards.
2. 1, 2, 3, 4, and 5 eliminate each other. Draw no cards.
3. 1, 2, 3, 4 and 5 eliminate each other. Draw no cards.
4. 1, 2, 3, 4, and 5 eliminate each other. Draw no cards.
5. 1, 2, 3, 4 and 5 eliminate each other. Draw no cards.
6. Draw 2 cards because LEADS eliminated.

FIG. 9

1. Draw 3 cards because the Robot gobbles up 3 Papers.
2. Draw 3 cards because the Robot gobbles up 3 Rocks.
3. Draw 3 cards because the Robot gobbles up 3 Scissors.
4. LEAD CARD.
5. Draw 1 card because the Robot gobbles up 1 Scissors.
6. Draw 2 cards because the Robot gobbles up 2 Rocks.

FIG. 10

1. Draw 3 cards because the UFO swallows 3 Scissors.
2. LEAD CARD.
3. Draw 3 cards because the UFO swallows the Robot.
4. Draw 2 cards because the UFO swallows 2 Rocks.
5. Draw 3 cards because the UFO swallows the Robot.
6. Draw 1 card because the UFO swallows 1 Paper.

FIG. 11

1. Draw 1 card because the Time Machine controls 1 Paper.
2. LEAD CARD.
3. Draw 3 cards because the Time Machine controls 3 Scissors.
4. Draw 3 cards because the Time Machine controls 3 Papers.
5. Draw 3 cards because the Time Machine controls 3 Rocks.
6. Draw 3 cards because the Time Machine controls the UFO.

FIG. 12

1. Draw 3 cards because 3 Papers cover Rocks.
2. 2, 3 and 4 eliminate each other. Draw no cards.
3. 2, 3 and 4 eliminate each other. Draw no cards.
4. 2, 3 and 4 eliminate each other. Draw no cards.
5. LEAD CARD.
6. Draw 2 cards because 1 Scissors cuts 1 Paper.

FIG. 13

1. Draw 3 cards because the Time Machine controls 3 Papers.
2. Draw 1 card because the Time Machine controls 1 Rock.
3. Draw 3 cards because the Time Machine controls the UFO.
4. EQUAL LEADS.
5. EQUAL LEADS.
6. EQUAL LEADS.

FIG. 14

1. 1, 2, 3, 4 and 5 eliminate each other. Draw no cards.
2. 1, 2, 3, 4 and 5 eliminate each other. Draw no cards.
3. 1, 2, 3, 4 and 5 eliminate each other. Draw no cards.
4. 1, 2, 3, 4 and 5 eliminate each other. Draw no cards.
5. 1, 2, 3, 4 and 5 eliminate each other. Draw no cards.
6. Draw 1 card because LEADS eliminated.

FIG. 15

1. 1, 3 and 5 eliminate each other. Draw no cards.
2. 2, 4 and 6 eliminate each other. Draw no cards.
3. 1, 3 and 5 eliminate each other. Draw no cards.
4. 2, 4 and 6 eliminate each other. Draw no cards.
5. 1, 3 and 5 eliminate each other. Draw no cards.
6. 2, 4 and 6 eliminate each other. Draw no cards.

FIG. 16

1. Draw no cards because Lava is the LEAD card.
2. LEAD CARD.
3. Draw no cards because Lava is the LEAD card.
4. Draw 3 cards because Lava is the LEAD card.
5. Draw no cards because Lava is the LEAD card.
6. Draw 3 cards because Lava is the LEAD card.

FIG. 17

1. Draw 3 cards because Lava is the LEAD card.
2. Draw 3 cards because Lava is the LEAD card.
3. Draw 3 cards because Lava is the LEAD card.
4. Draw no cards because Lava is the LEAD card.
5. EQUAL LEADS (Draw 4 cards because 2 or more Lava's appeared).
6. EQUAL LEADS (Draw 4 cards because 2 or more Lava's appeared).

Second Game

Figure 18:
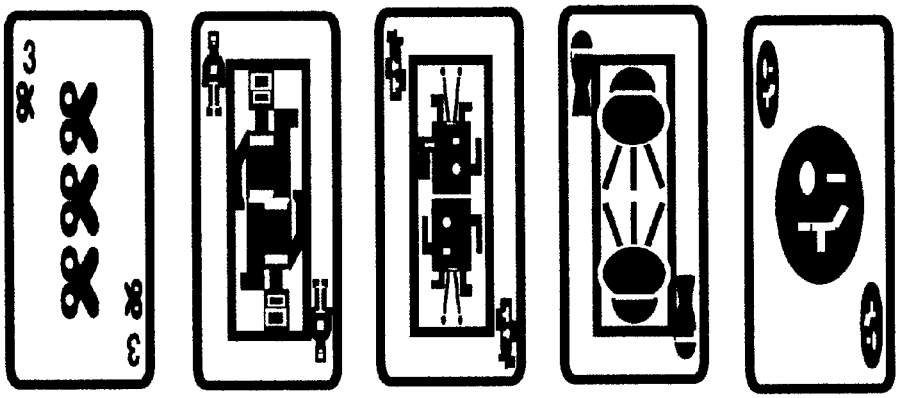
Figure 19:
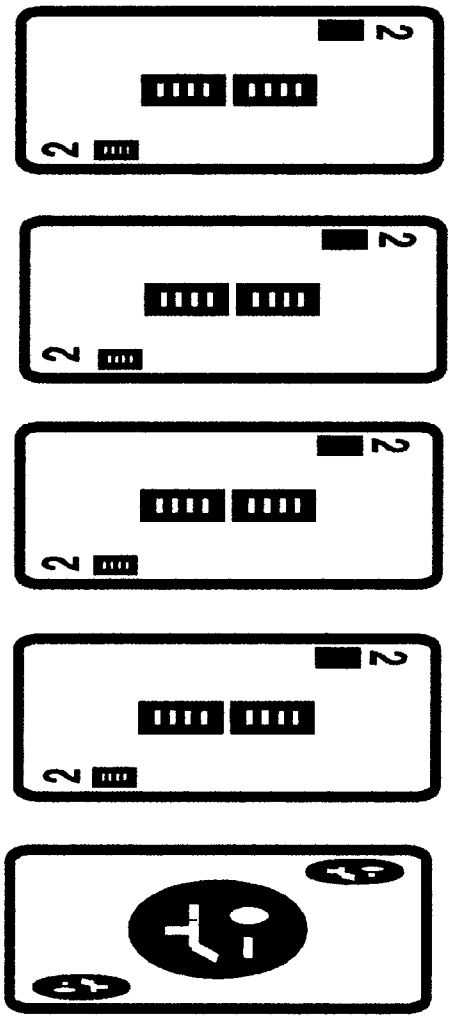
Figure 20:
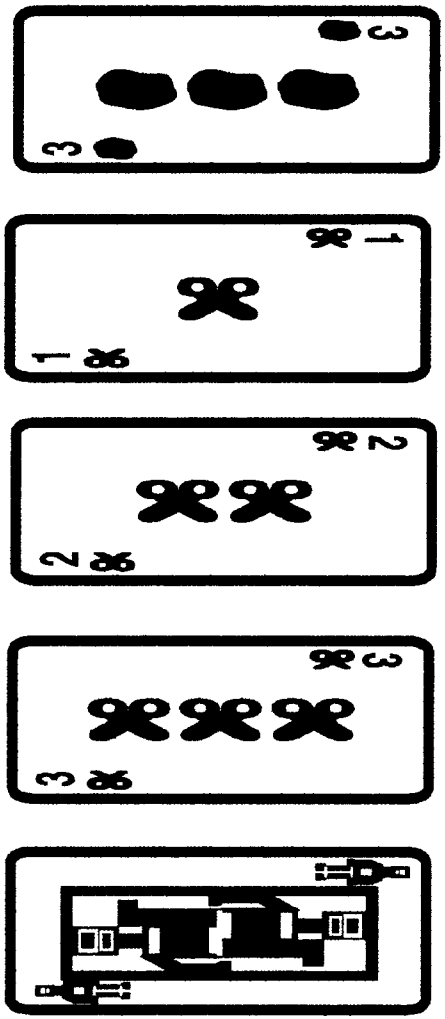
Figure 21:
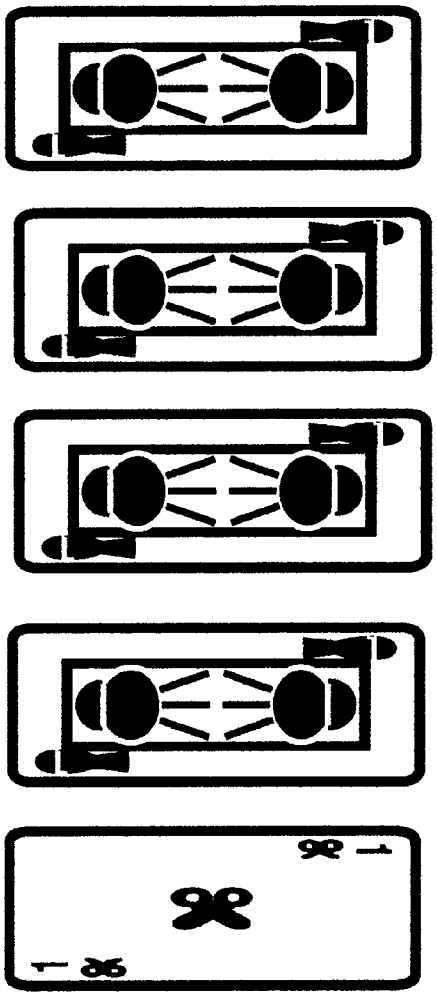
Figure 22:
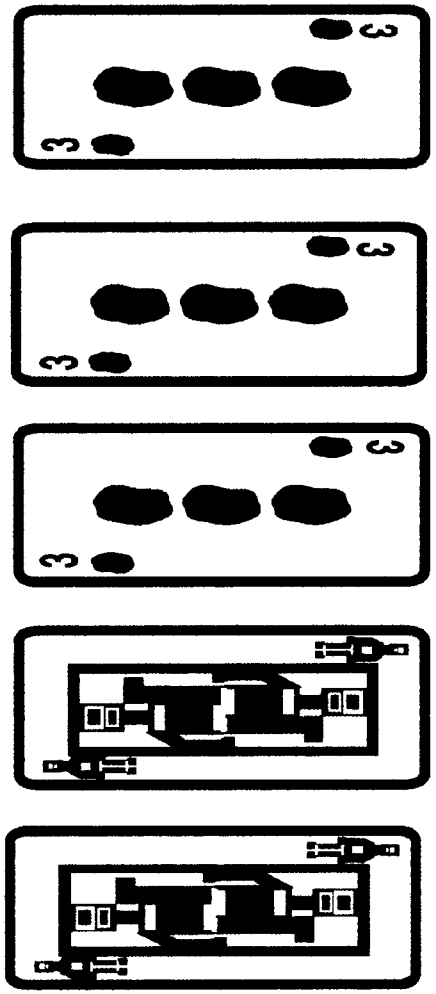
Figure 23:
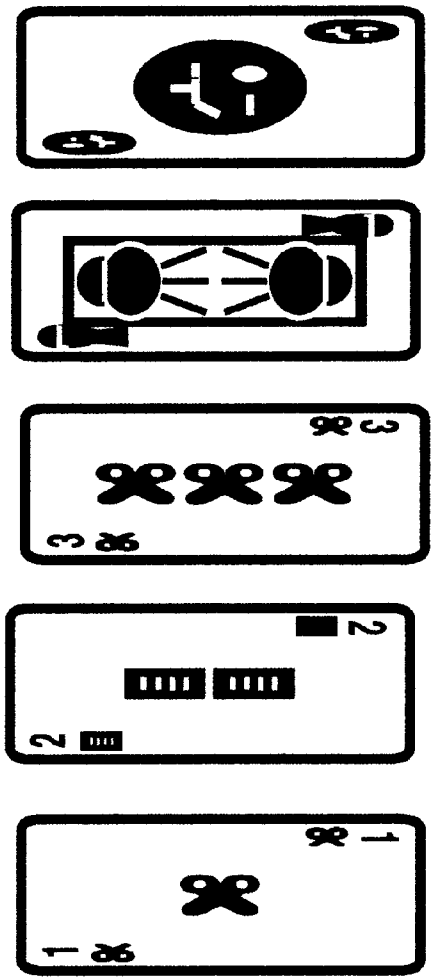
Figure 24:
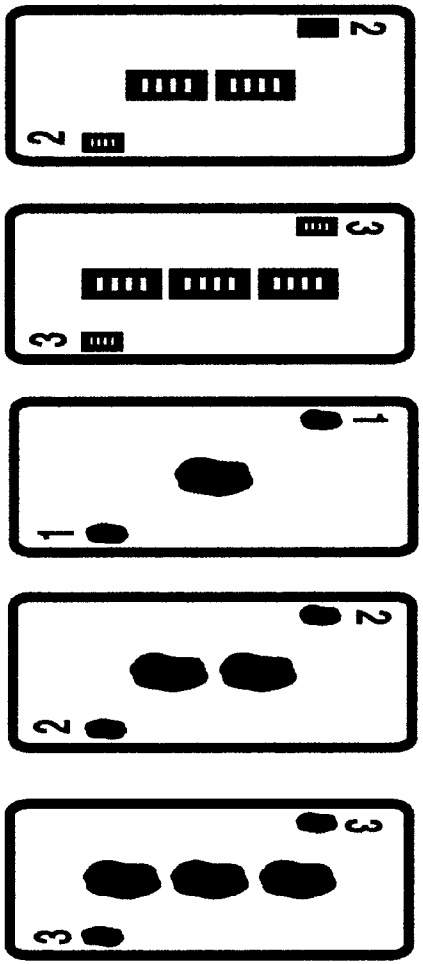
Figure 25:
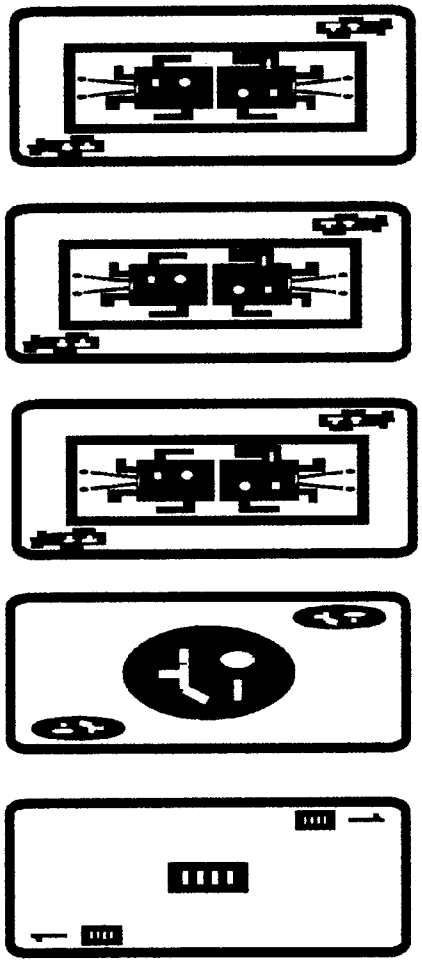
Figure 26:
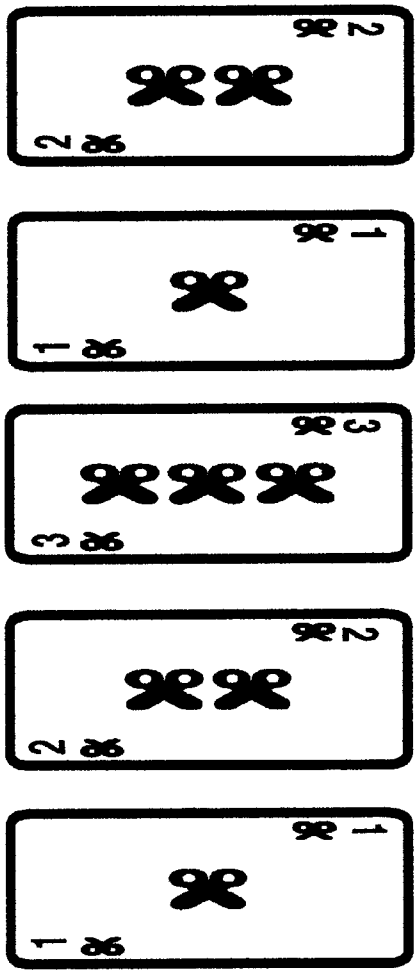
Figure 27:
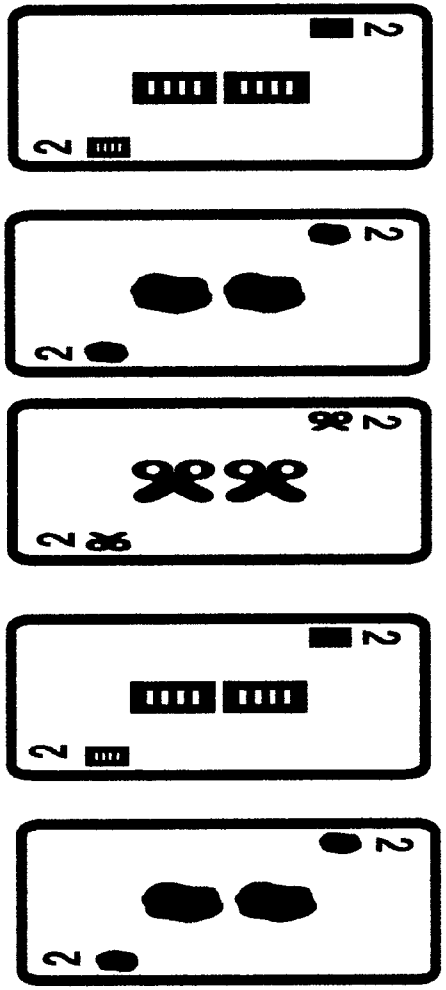
Figure 28:
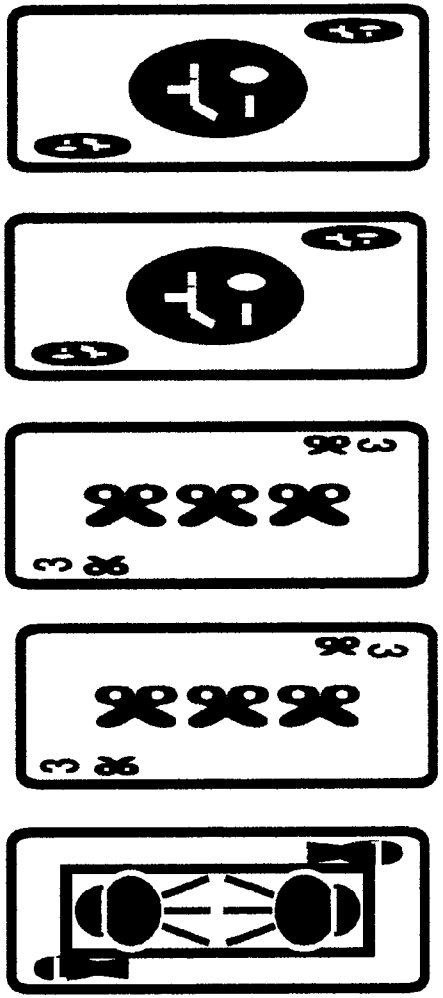
Figure 29:
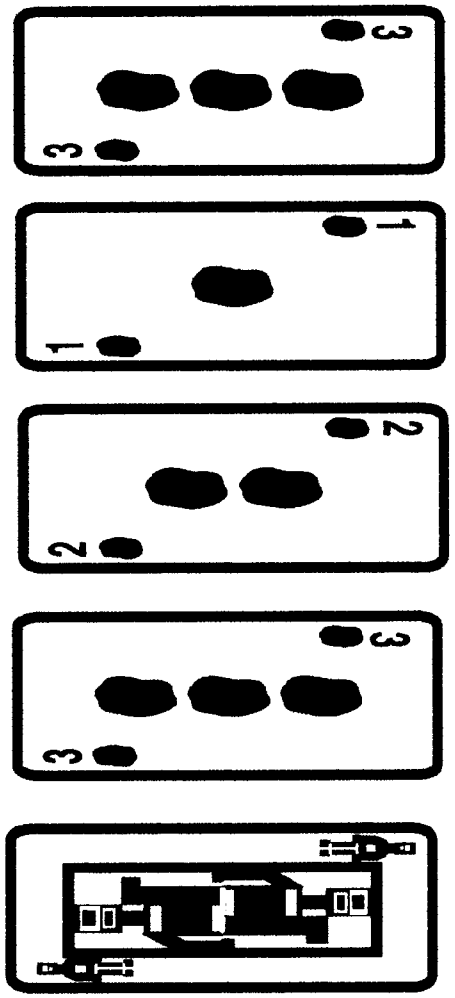
Figure 30:
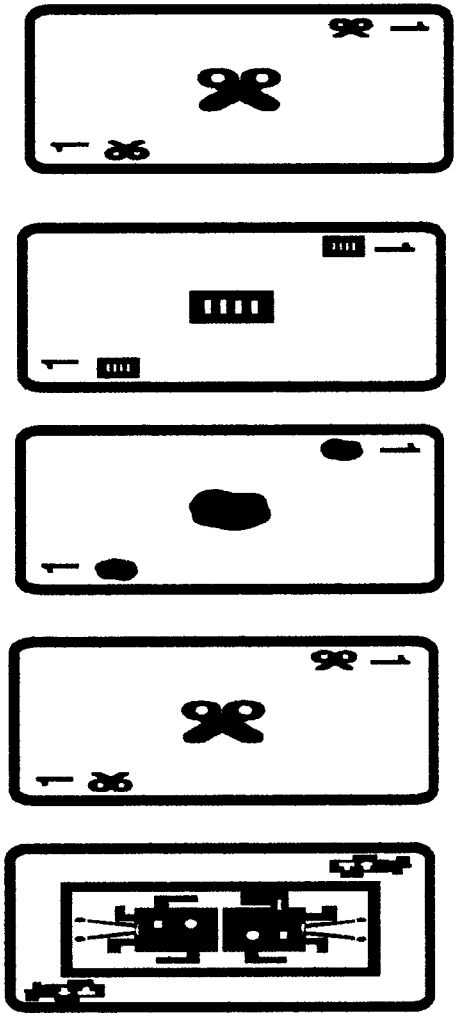
Figure 31:
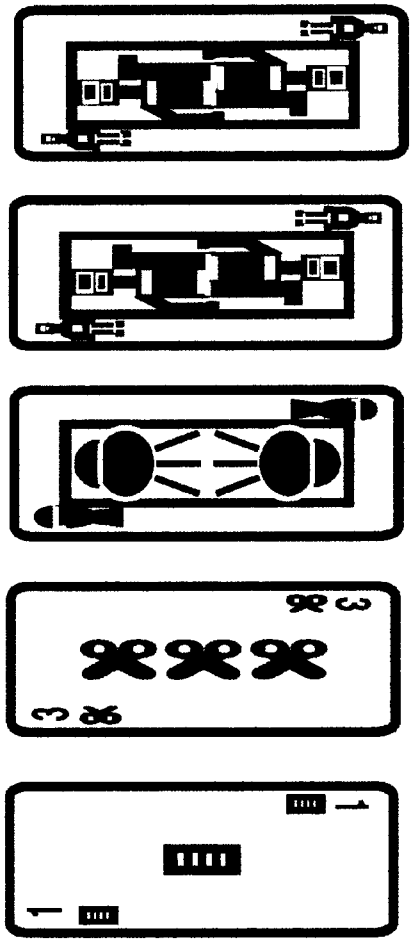
Figure 32:
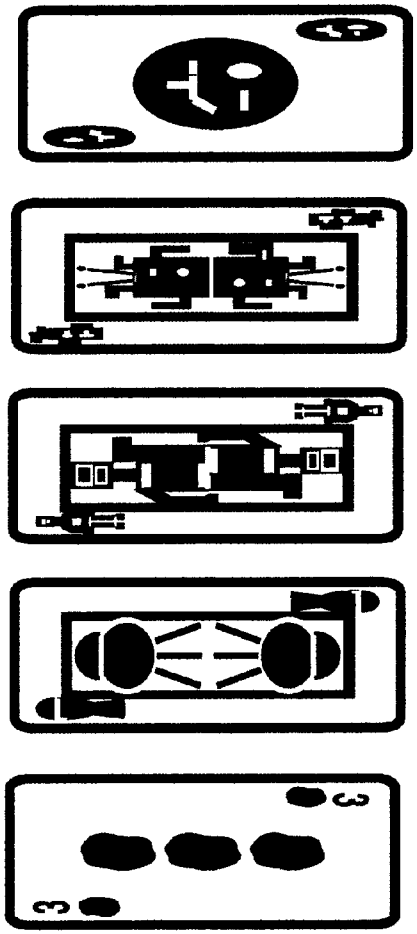
Figure 33:
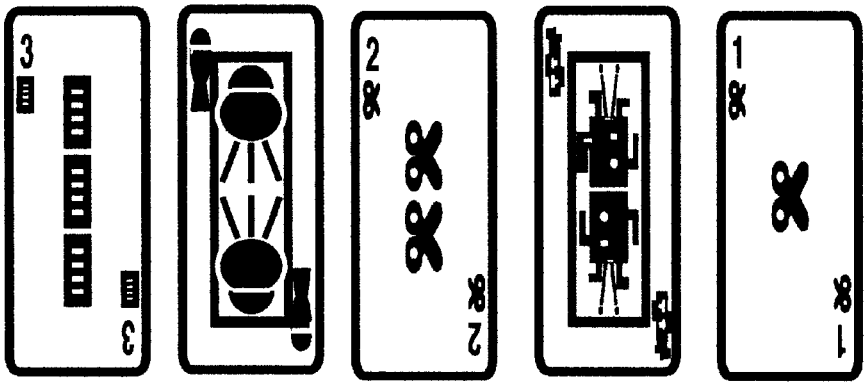

The object of the second game is for players to play hands of cards against each other. Each player's hand is to consist of five cards. It should be noted that the second game is played with the second embodiment of the deck of cards. So, although the illustrations are in black and white, each card will in fact bear one of four suits (e.g. one of four colors) in addition to its (1) other suit and numerical value, (2) face card marking, or (3) high card marking. There are fourteen different possible hand combinations with number one being the best possible hand, down to number fourteen being the least. They are as follows:

One (FIG. 18) Lava Straight Flush (Lava High, Linear, All Same Color);

Two (FIG. 19) Four identical cards with a Lava card;

Three (FIG. 20) Straight Flush (Linear, All Same Color);

Four (FIG. 21) Four identical cards with any card remaining;

Five (FIG. 22) Full Hand (Three Identical cards with Two Identical cards);

Six (FIG. 23) Flush (All Same Color);

Seven (FIG. 24) Straight (Linear);

Eight (FIG. 25) Three identical cards with any two cards remaining;

Nine (FIG. 26) Five cards with all Papers, all Rocks, all Scissors on each or (FIG. 27) any five Paper, Rock, Scissor cards with the same number of illustrations on each;

Ten (FIG. 28) Two identical cards with another type of Two identical cards with one card remaining;

Eleven (FIG. 29) Four cards with all Papers, all Rocks, all Scissors on each along with any fifth card remaining or (FIG. 30) any four Paper, Rock, Scissor cards with the same number of illustrations on each along with any fifth card remaining;

Twelve (FIG. 31) Two Identical cards with any three cards remaining;

Thirteen (FIG. 32) A Lava card with any four cards remaining;

Fourteen (FIG. 33) Count the number of illustrations on all your cards counting the Robots, Time Machines and UFO's as four illustrations each.

NOTE: The hands illustrated in FIG. 19–FIG. 33 are interchangeable with other cards as long as they meet the criteria described within that hand combination.

As mentioned above, this game requires the use of the color of the cards as an additional "suit." Thus, the term "identical" cards within the context of game two does not refer to the color of the cards. Instead, "identical" cards are the same exact cards without reference to their color.

A STRAIGHT will require five (5) cards in a linear order. The linear order for a STRAIGHT shall be any five (5) cards in the following order (listed from lowest to highest): Lava, One Paper, Two Papers, Three Papers, One Rock, Two Rocks, Three Rocks, One Scissor, Two Scissors, Three Scissors, A Robot, A Time Machine, A UFO, and a Lava.

A FLUSH will be any five (5) cards with the same colors.

A STRAIGHT FLUSH will be a STRAIGHT as described above with the same color combination of cards as described by a FLUSH.

A Lava STRAIGHT FLUSH is the best possible hand. This hand will consist of a Scissors card with three Scissors, a Robot, a Time Machine, a UFO and a Lava card. ALL of these cards are to be the SAME colors.

To begin, one player shuffles the deck well and distributes amongst all the players five cards each, all face down. Each player picks up his or her own cards, attempting to create the best possible hand. After looking at his or her own cards, each player, beginning from the left of the person who dealt the cards, in a clockwise rotation, is to determine if he or she wishes to keep all five of their cards or to discard as many as they like up to three cards (four if holding a Lava card) and then draw the amount of cards they discarded.

When all the players are done drawing cards, all the players then show their cards. The best hand combination of cards as described above (ranked one through fourteen) is the winner.

Should two or more players fall into the same group of hand combinations as stated in hands two through thirteen, the following supplimentary guidelines (rules) are used to determine which are the better cards and/or is the better hand:

Fifteen) A) Lava cards are the best. B) Robots, Time Machines and UFO's are equally the next best. C) Paper, Rock and Scissors with three illustrations on each are equally the next best. D) Paper, Rock and Scissors with two illustrations on each are equally the next best. E) Paper, Rock and Scissors with one illustration on each are equally the least best.

Sixteen) Always use a player's greater card or greater amount of identical cards (whenever applicable) to determine the better hand using rule number Fifteen.

Seventeen) Should two or more players greater card(s) fall into the same group(s) of cards as described in rule number Fifteen (A, B, C, D, or E), those players are to use their next best card(s) to determine the better hand.

Eighteen) Should two or more players remain with the same groups of cards, throughout their hand, they are to use rule number Nineteen.

Nineteen) Paper covers Rock, Rock breaks Scissors, Scissors cut Paper. Robots smash Time Machines, Time Machines control UFO's, UFO's swallow Robots.

Twenty) Players are to use rule number Nineteen (only when rule number Eighteen applies) beginning as they did to determine their hand, from their greater card(s) down, one at a time, to their last card. These are referred to as levels of elimination.

Twenty-One) Should at any level of elimination, all three cards in a group equally attack each other, they and any like them are to be eliminated at that level only.

Twenty-Two) Once a player has a dominant card, during any level of elimination, the elimination stops and that person holds the best hand.

Twenty-Three) When players hold the same type of hand combinations as described in hand number Nine, players are to count the total number of illustrations on all their cards, the more being the greater.

Twenty-Four) When players hold the same type of hand combinations as described in hand number Eleven, players are to use their fifth card to determine which is the better hand. Should the fifth cards be identical or equally eliminate, players are to count the total number of illustrations on all their cards, the more being the greater.

Sample Hands

FIG. 34–FIG. 38 display sample hands with numbers to the left of the cards. Those numbers represent a player's five card hand. The letters below each card represent that type of card with reference to rule number Fifteen.

Figure 34:
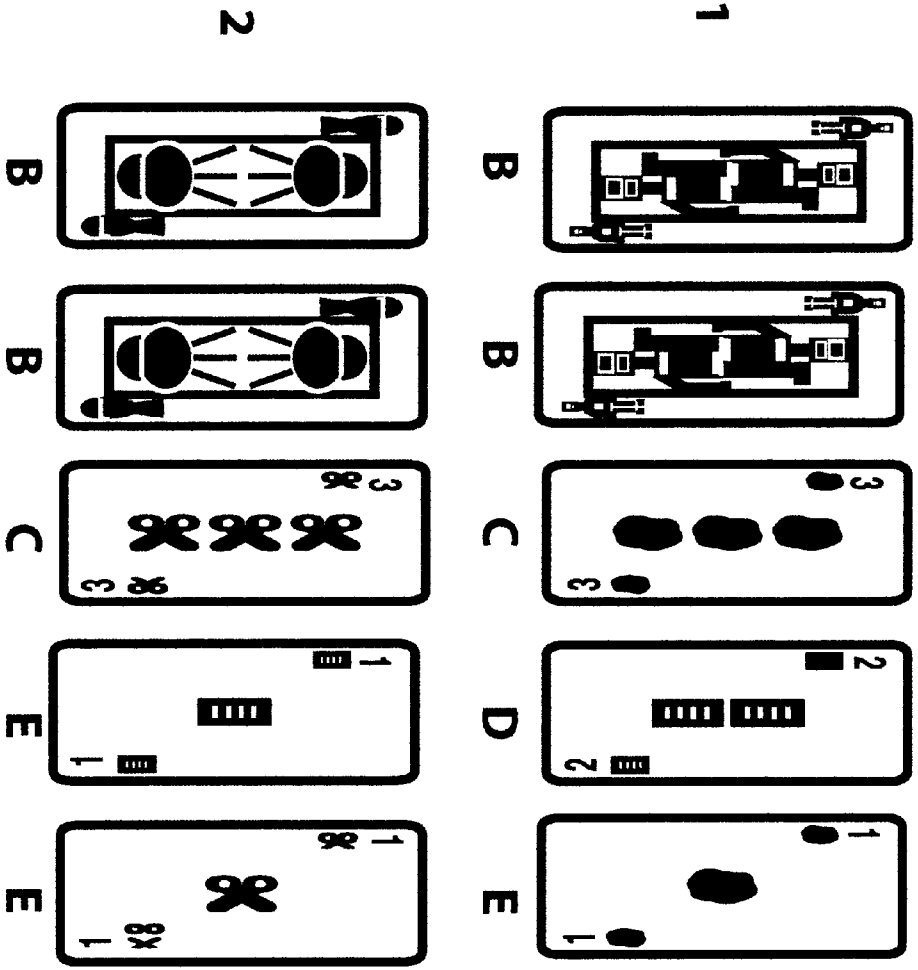

FIG. 34: Player One (1) has the better hand because his fourth card (D) is better than Player Two's (2) fourth card (E). Note: The rules discussed in rule number Nineteen do not apply to this hand (see rule number Seventeen).

FIGS. 35–38 consist of players hands of cards that fall into the same groups of cards throughout their entire hand. When these types of hands appear, players are to use rules Eighteen through Twenty-Two (by applying rule number Nineteen) to determine the best hand.

Figure 35:
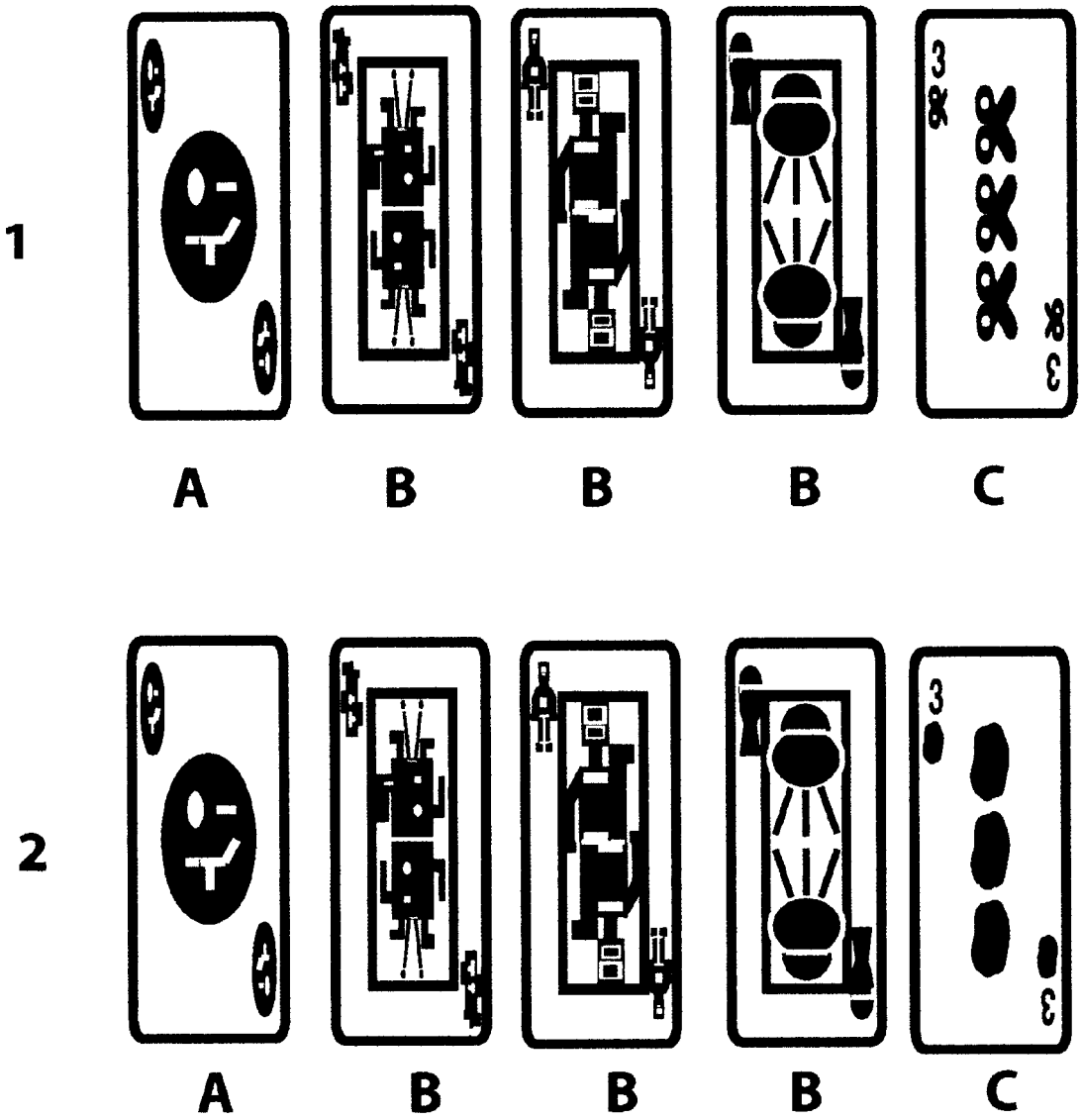

FIG. 35 Player Two (2) has the better hand because its fifth card (C) breaks Player One's (1) fifth card (C).

Figure 36:
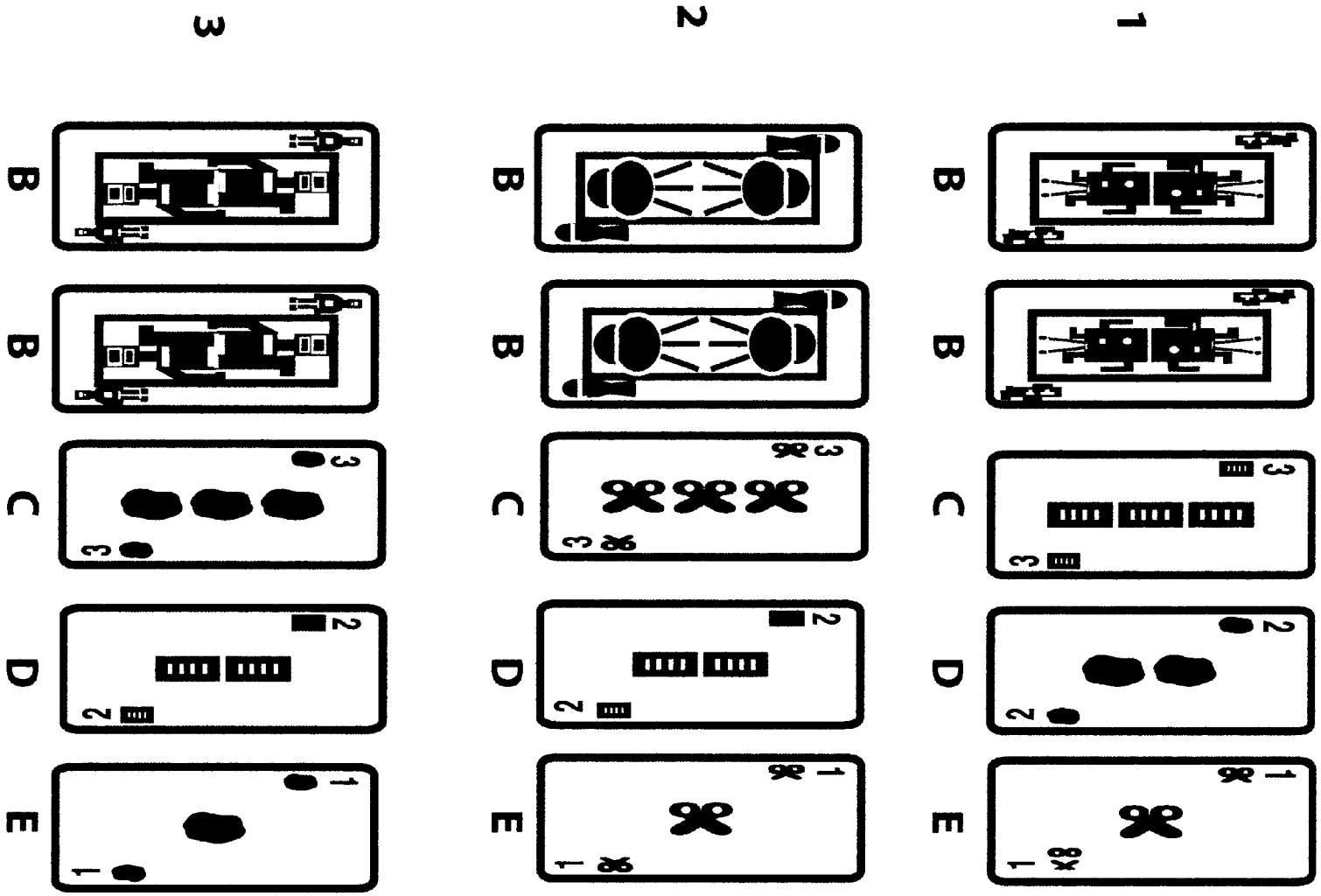

FIG. 36 The first three cards (B, B and C) of each hand attack and eliminate each other (see rule number Twenty-One). Player Three (3) has the better hand because its fourth card (D) covers Player One's (1) fourth card (D) and its fifth card (E) breaks Player Two's (2) fifth card (E).

Figure 37:
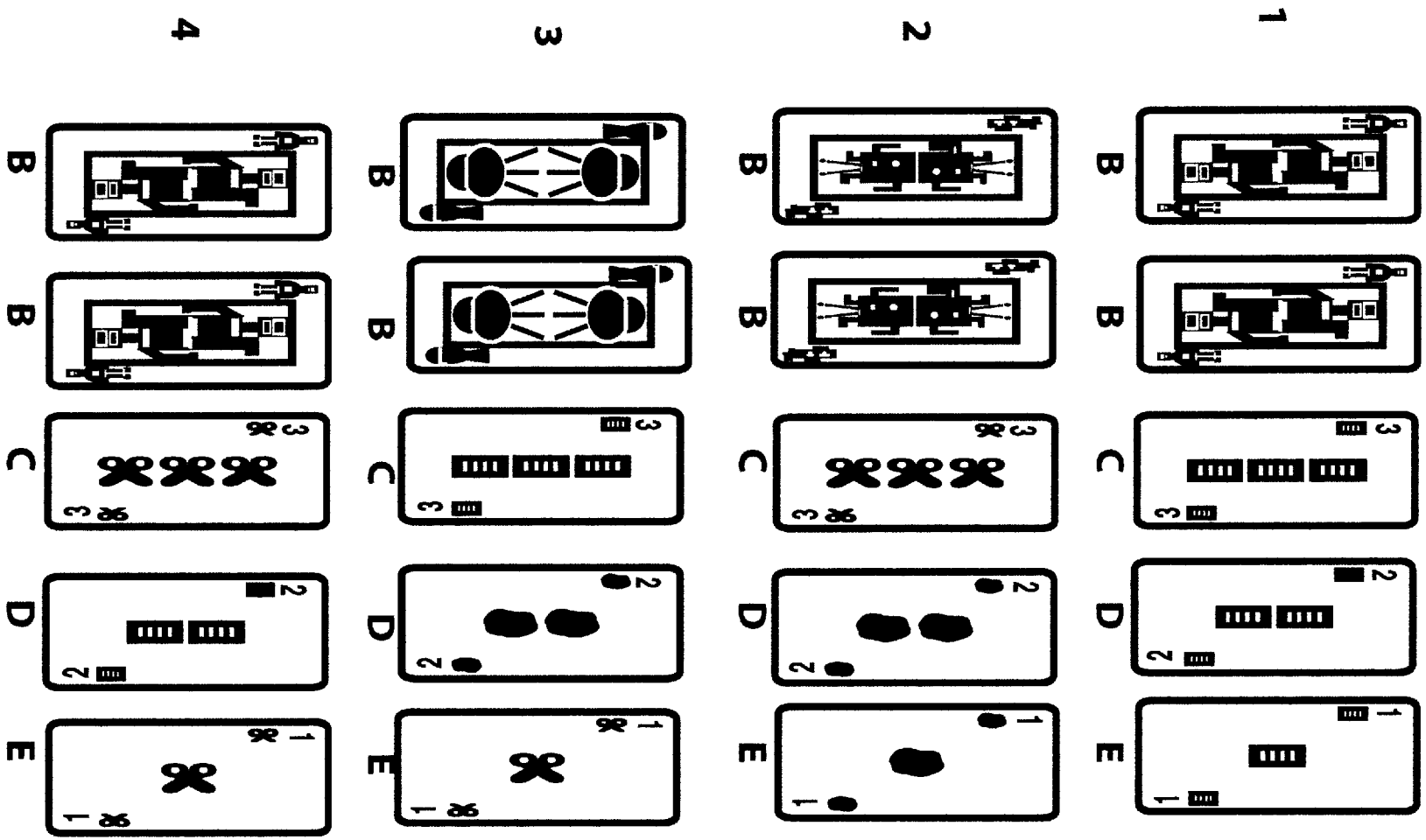

FIG. 37 The first two cards (B and B) of each hand attack and eliminate each other (see rule number Twenty-One). Player Four (4) has the better hand because its third card (C) cuts Players One's (1) and Player Three's (3) third card (C) and its fourth card (D) covers Player Two's fourth card (D).

Figure 38:
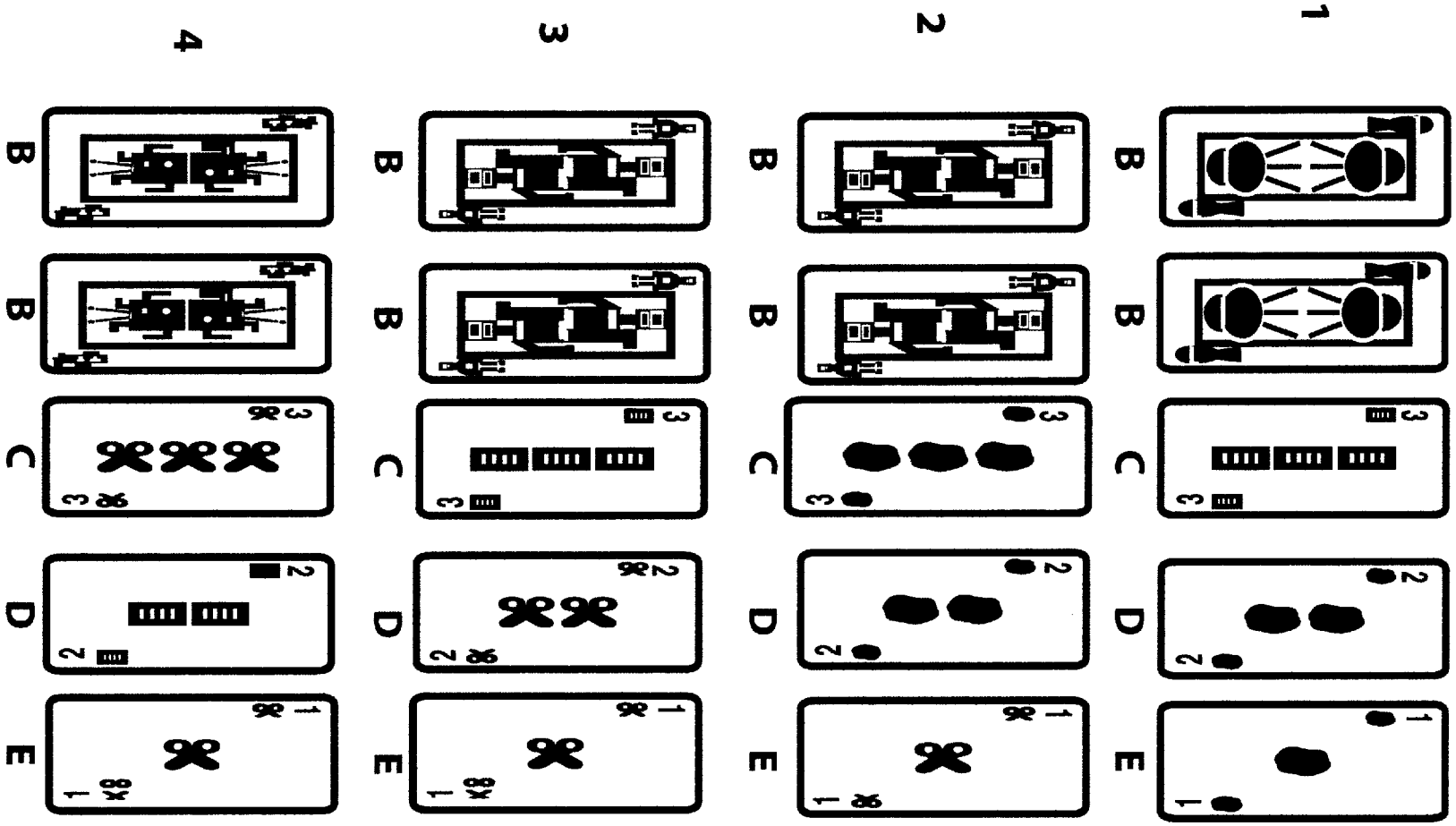

FIG. 38 The first four cards (B, B, C and D) of each hand attack and eliminate each other (see rule number Twenty-One). Player One (1) has the better hand because its fifth card (E) breaks Players Two (2), Three (3) and Four's (4) fifth card (E).

Both games have been satisfactorily played and tested many times (over one hundred times each) with regards to the effectiveness of the enclosed details.

Various changes in the details, steps and components that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. A method of playing a card game with a plurality of players using a deck of cards including (a) a first group of cards, each card of said first group having a indicia of numerical value of one, two, or three and a marking designating one of three different suits p, r, and s, (b) a second group of cards, each card of said second group having a marking designating it as one of three different face cards, x, y, and z, and (c) a third group of cards, each card of said third group having a marking designating it as a high card, wherein an object of the card game is to become a first player to go out by playing a card on a discard pile, said method of playing comprising the steps of:

(1) Dealing each player five cards face down;

(2) Placing the deck face down in a play area;

(3) Flipping over a top card of the deck, thus forming the discard pile;

(4) Having each player take a turn by placing one card on top of the discard pile and drawing cards according to predetermined game rules, whereby play continues until a player goes out, and wherein players draw cards based on the card they play on the top card of the discard pile according to the following relationship:

(A) beating the top card results in drawing no cards;

(B) identically matching the top card results in drawing either (1) the number on the card (for numerical suit cards), (2) 3 cards in the case of face cards, or (3) 4 cards in the case of high cards;

(C) not beating the top card results in drawing either (1) using Table 1 to determine a draw as follows:

| IF LEAD CARD IS↓ | THEN→ | 3 PAPERS DRAW | | | 3 ROCKS DRAW | | | 3 SCISSORS DRAW | | |
|---|---|---|---|---|---|---|---|---|---|---|
| 3 PAPERS | | 0 | 1 | 2 | 3 | 3 | 3 | ** | 1 | 2 |
| 2 PAPERS | | ** | 0 | 1 | ** | 2 | 2 | ** | ** | 1 |
| 1 PAPER | | ** | ** | 0 | ** | ** | 1 | ** | ** | ** |
| 3 ROCKS | | ** | 1 | 2 | 0 | 1 | 2 | 3 | 3 | 3 |
| 2 ROCKS | | ** | ** | 1 | ** | 0 | 1 | ** | 2 | 2 |
| 1 ROCK | | ** | ** | ** | ** | ** | 0 | ** | ** | 1 |
| 3 SCISSORS | | 3 | 3 | 3 | ** | 1 | 2 | 0 | 1 | 2 |
| 2 SCISSORS | | ** | 2 | 2 | ** | ** | 1 | ** | 0 | 1 |
| 1 SCISSORS | | ** | ** | 1 | ** | ** | ** | ** | ** | 0 |

wherein, the lead card of Table 1 is the top card, 0 is an indication that said Table 1 does not apply (refer to part (B)), and ** indicates a situation in which a card will not appear as the top card; (2) x, where x is a numerical value of a card played if played on any face card, or (3) zero for any numerical suit card that is played on a high card or 3 cards for any face card played on a higher ranking face card or on a high card.

* * * * *